US008672176B2

(12) United States Patent
Sayasithsena

(10) Patent No.: US 8,672,176 B2
(45) Date of Patent: Mar. 18, 2014

(54) BEVERAGE HOLDING DEVICE

(76) Inventor: Souksomboun Sayasithsena, Annandale, VA (US)

( * ) Notice: Subject to any disclaimer, the term of this patent is extended or adjusted under 35 U.S.C. 154(b) by 1493 days.

(21) Appl. No.: 12/028,037

(22) Filed: Feb. 8, 2008

(65) Prior Publication Data

US 2008/0190948 A1 Aug. 14, 2008

Related U.S. Application Data

(60) Provisional application No. 60/889,243, filed on Feb. 9, 2007.

(51) Int. Cl.
*B65D 25/04* (2006.01)

(52) U.S. Cl.
USPC ..... 220/737; 220/501; 220/506; 220/4.01

(58) Field of Classification Search
USPC ..... 220/739, 737, 738, 740, 501, 23.87, 220/4.03, 4.01, 560.03, 571, 676, 506
See application file for complete search history.

(56) References Cited

U.S. PATENT DOCUMENTS

| | | | | | |
|---|---|---|---|---|---|
| 96,144 | A | * | 10/1869 | Putnam | 47/83 |
| 592,781 | A | * | 11/1897 | Hertwig | 220/506 |
| 1,168,027 | A | * | 1/1916 | Nirdlinger | 73/426 |
| 3,918,920 | A | * | 11/1975 | Barber | 422/560 |
| 5,406,808 | A | * | 4/1995 | Babb et al. | 62/457.4 |
| 5,562,229 | A | * | 10/1996 | Callahan | 220/694 |
| 5,687,874 | A | * | 11/1997 | Omori et al. | 220/737 |
| 6,039,206 | A | * | 3/2000 | DeFrancesco | 220/737 |
| 7,328,876 | B2 | * | 2/2008 | Jones | 248/311.2 |
| 2005/0194345 | A1 | * | 9/2005 | Beggins | 215/386 |

* cited by examiner

*Primary Examiner* — Stephen Castellano
(74) *Attorney, Agent, or Firm* — Kunzler Law Group

(57) ABSTRACT

An apparatus for holding a beverage includes a base, a frame, and a plurality of biasing members. The base includes at least one inner region and at least one outer region for collecting moisture. The frame is configured to be supported by the base and to receive drinking vessels of varying sizes and configurations. The plurality of biasing members are detachably coupled to the frame and form with the frame an inner cavity of varying capacity for supporting a drinking vessel. The capacity of the inner cavity is adaptively configured when a portion of the drinking vessel is received in the inner cavity.

19 Claims, 9 Drawing Sheets

900

BEVERAGE HOLDING DEVICE

RELATED APPLICATIONS

This application claims the benefit of the earlier filing date under 35 U.S.C. §119(e) of U.S. Provisional Application Ser. No. 60/889,243 filed Feb. 9, 2007, entitled "Apparatus and Method for a Beverage Holding Device," the entirety of which is incorporated by reference.

FIELD OF THE INVENTION

The present invention relates to an apparatus for securing beverage containers.

BACKGROUND OF THE INVENTION

Beverages are generally consumed from drinking vessels of various sizes, shapes, and configurations including containers, such as: bottles, boxes, cans, cups, glasses, jars, mugs, pouches, tumblers, and the like. When individuals are not consuming their beverages, they often set these vessels down on a counter, table top, dashboard, or other suitable resting surface, such as the ground. Unfortunately, the physical dimensioning of these drinking vessels oftentimes makes them prone to overturning or spilling their fluid when inadvertently jostled. In other instances, placing beverages directly on a resting surface can lead to condensation rings, as well as many other undesirable moisture-related effects.

Therefore, there is a need for beverage holding devices that are able to stabilize a drinking vessel despite its configuration, as well as prevent condensation and/or inadvertently spilled fluid from wetting and/or damaging a resting surface.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DESCRIPTION OF THE PREFERRED EMBODIMENT

A preferred apparatus and method for securing a beverage container are described. In the following description, for the purpose of explanation, numerous specific details are set forth in order to provide a thorough understanding of the preferred embodiments of the invention. It is apparent, however, that the preferred embodiments may be practiced without these specific details or with an equivalent arrangement. In other instances, well-known structures and devices are shown in block diagram form in order to avoid unnecessarily obscuring the preferred embodiments of the invention.

Figure 1A:
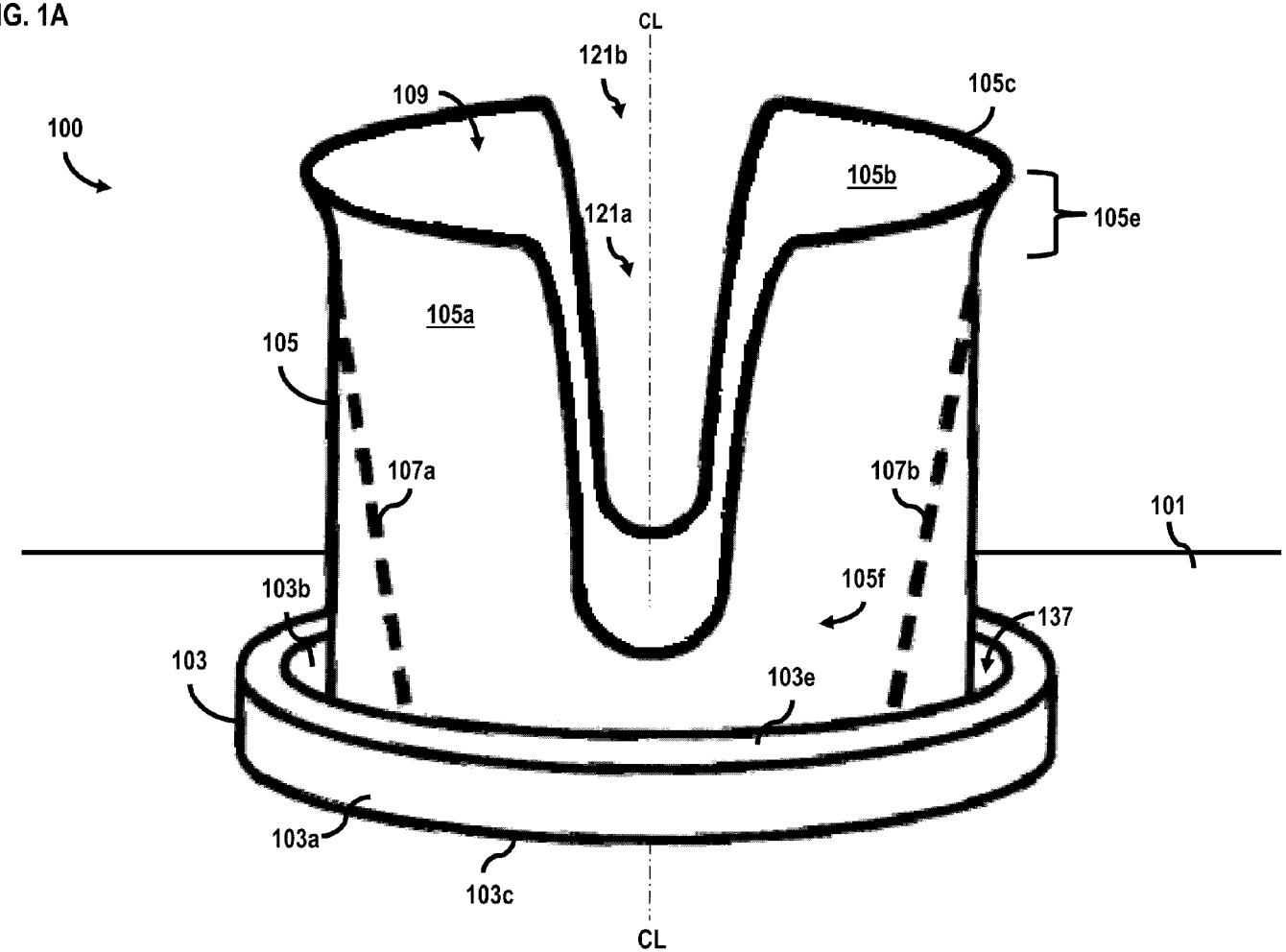
FIGS. 1A and 1B schematically illustrate a beverage holding apparatus with an upper frame and a lower base, according to various exemplary embodiments.
Figure 1B:
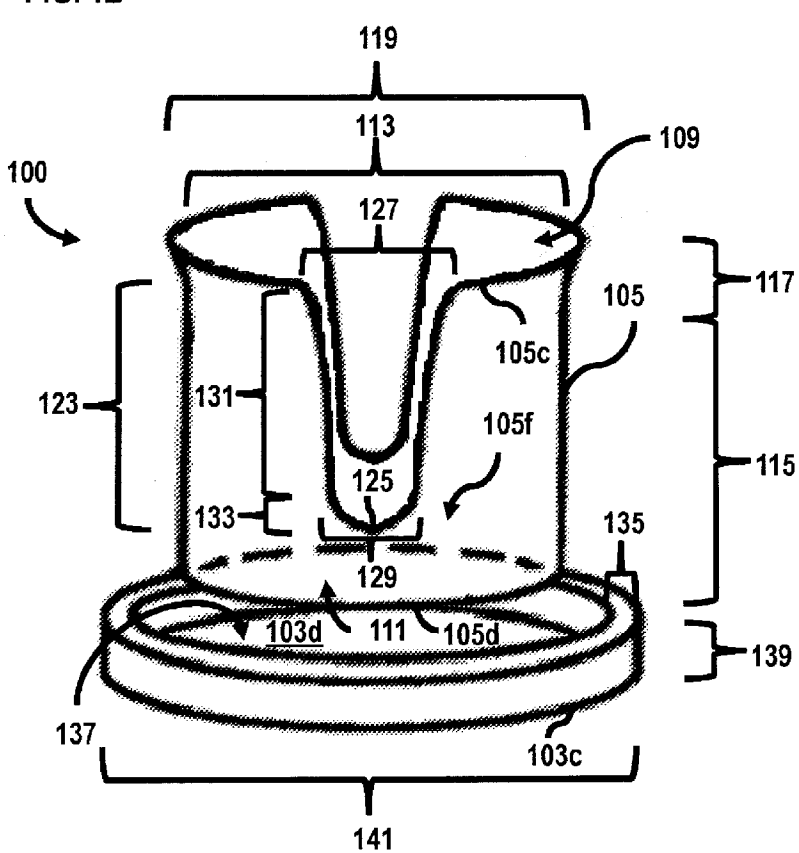

FIGS. 1A and 1B schematically illustrate a beverage holding apparatus 100, according to various exemplary embodiments. In one particular implementation, beverage holding apparatus 100 is configured to securely restrain, or otherwise stabilize, a drinking vessel (not illustrated) in an upright fashion on a resting surface 101, as well as collect condensate buildup and/or prevent fluid from inadvertently spilling onto resting surface 101. The drinking vessel may be any beverage container or enclosure, e.g., a bottle, box, can, cup, glass, jar, mug, pouch, tumbler, etc., and may be formed having a homogenous, i.e., relatively unvarying, or a heterogeneous, i.e., various sizes, shapes, etc., configuration. While specific reference will be made thereto, it is to be appreciated that the various exemplary embodiments also find application in other devices for containing, or otherwise securely holding, an object(s), whether or not the object(s) is a drinking vessel. As used herein, the terms beverage container, beverage enclosure, and drinking vessel are interchangeable. It is contemplated that beverage holding apparatus 100 may embody many forms and include multiple and/or alternative components and configurations.

It is noted that within warm, moist environments, beverage containers, e.g., bottles, boxes, cans, cups, glasses, jars, mugs, pouches, tumblers, and the like, chilled below the dew point temperature of the ambient air, collect on their exterior façades condensate that trickles down onto the containers' resting surface, i.e., an item of furniture, a vehicle console or dashboard, a tabletop, etc. Further, when cold beverage containers are placed upon warmer resting surfaces, heat transferred from the resting surface to the container causes the resting surface temperature to decline thereby enabling moisture from the ambient environment to directly deposit onto the resting surface. Similarly, when hot beverage containers are set upon cooler resting surfaces, water vapor from the beverage itself, as well as any condensate from the beverage container, can transfer directly to the resting surface. As such, any moisture buildup on the resting surface can cause permanent and irreparable damage to the material of the surface, damage such as water stains, veneer separation, raised grains, discoloration, etc., especially as the permeability of the material of the resting surface increases.

Traditionally, beverage drinkers have utilized devices, such as coasters, doilies, saucers, etc. (denoted as "coasters"), below their beverage containers in order to absorb any undesirable moisture buildup. Unfortunately, the absorbed condensate tends to quickly saturate these devices thereby allowing the moisture to, in turn, be transferred to the containers' resting surface. Moreover, because heat transfer through coasters generally occurs rather quickly, the above conditions are merely delayed, but not eliminated. Furthermore, because coasters are generally made of absorbent materials, e.g., fabric, paper, etc., a cohesive bond can form between the coaster and the beverage container by way of surface tension. Oftentimes, these bonds only separate after the drinking vessel is picked up, thus creating the possibility of condensate runoff and/or spillage. Some coasters utilize heterogeneous surfaces, such as bumps, grooves, ridges, etc., to alleviate the surface tension effects; however, these uneven surfaces tend to exacerbate the possibility of the drinking vessel tilting and/or spilling.

In the case of non-permeable coasters, as the coaster collects moisture, the surface tension of a resultant "pool" can build to the point where the beverage container can be "lifted" from the coaster's surface. When lifting occurs, the container can then "float" upon the pool of moisture, thus creating the possibility of undesirable container displacement, especially beyond a boundary edge of a coaster or resting surface.

Mobile environments present a further possibility of a beverage container inadvertently overturning due to environmental vibrations and/or cornering forces. In fact, the possibility is so great that beverage spills caused by beverage containers unexpectedly overturning are attributed to numerous vehicular accidents each year. Automobile manufacturers include cup holders incorporated into console and/or dashboard designs; however, these holders generally do not accommodate drinking vessels of varying sizes, shapes, and configurations. Further, these incorporated cup holders do not firmly secure beverage containers. For example, the incorporated cup holders may be too shallow, too wide, etc.

Accordingly, the various exemplary embodiments of beverage holding apparatus 100 stem from the recognition that consumers can benefit from beverage holding devices configured to securely restrain, or otherwise stabilize, drinking vessels of various sizes, shapes, and configurations, as well as configured to prevent condensation and/or inadvertently spilled fluid from wetting and/or damaging a resting surface.

As seen in FIGS. 1A and 1B, beverage holding apparatus 100 includes a lower base 103, an upper frame 105, and a plurality of biasing members, e.g., biasing members 107*a* and 107*b*. Frame 105 can be a relatively cylindrically shaped, thin-walled shell structure including a top opening 109 for receiving drinking vessels of various sizes, shapes, and/or configurations, as well as a bottom opening 111 seen only in FIG. 1B for allowing condensate to roll off of and/or fluid spilled from the drinking vessels to be collected by base 103. Accordingly, base 103 can be a relatively cylindrically shaped disk for supporting frame 105, as well as a drinking vessel resting thereon. As will be described in more detail with respect to FIGS. 3 and 7, frame 105 may be detachably coupled to, or integrally formed from, base 103. It is noted, however, that in FIG. 1B, frame 105 is illustrated as detachably decoupled from base 103 and various features are not illustrated in order to avoid unnecessarily obscuring the depiction. Base 103 is more fully described in conjunction with FIGS. 2A-2C and 3.

Figure 7:
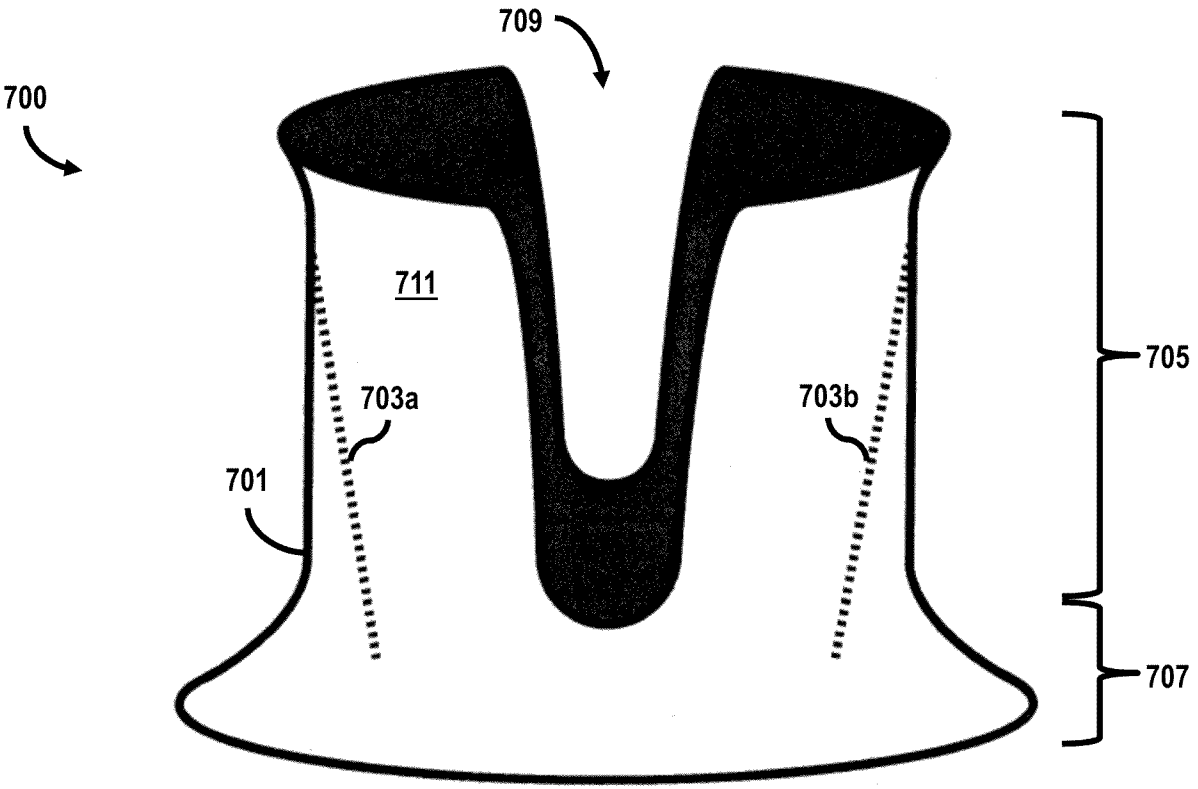
FIG. 7 schematically illustrates a contiguously formed beverage holding apparatus, according to an exemplary embodiment.

Frame 105 includes an outer façade 105*a* and an inner façade 105*b*. The distal edges of façades 105*a* and 105*b* respectively terminate at an upper peripheral edge 105*c* and a lower peripheral edge 105*d* seen only in FIG. 1B. As will be explained with respect to FIG. 3, lower peripheral edge 105*d* of frame 105 may further include a coupling region, such as coupling region 301 illustrated in FIG. 3, for detachably coupling to base 103. Accordingly, as best seen in FIG. 1B, as frame 105 extends from lower peripheral edge 105*d*, frame 105 rises cylindrically with an inner diameter 113 to a predetermined midrise height 115. From midrise height 115 to top height 117, the cylindrical diameter increases from the inner diameter 113 to an outer diameter 119. This increase in diameter may be varied linearly, exponentially, with a constant bend radius, or with any other suitable configuration. In this manner, as seen in FIG. 1A, a curved region 105*e* is formed in an upper portion of frame 105, which, in particular embodiments, is an arcuate collar. According to other embodiments, as seen in FIG. 1B, the diameter of frame 105 may vary linearly, exponentially, with a constant bend radius, etc., from the inner diameter 113 to the outer diameter 119, or any predetermined heights thereof and/or therebetween. For example, frame 105 may be provided having a frustoconical or polygonal prism configuration exhibiting an increasing or decreasing diameter/width from the top opening 109 to the bottom opening 111. In other instances, frame 105 may include a contoured configuration, such as illustrated in FIG. 7. In any event, an inner cavity region of frame 105 may be formed between the openings 109 and 111 for receiving a drinking vessel of various sizes, shapes, and/or configurations.

According to various embodiments, frame 105 may be formed from a variety of materials, such as clays, ceramics, glasses, metals, polymers, plastics, rubbers, etc., as well as combinations thereof, wherein varying materials of frame 105 may be coupled and/or integrated together in any known manner, such as by adhesive or chemical bonds. Accordingly, frame 105 may be manufactured using any known method, such as by blowing, casting, extruding, forging, machining, molding, stamping, etc., as well as combinations thereof. In particular implementations, frame 105 may be configured with insulating and/or nonconductive materials so as to limit the transfer of heat between a drinking vessel supported by apparatus 100 and frame 105, as well as between the drinking vessel and an ambient environment. Such configurations enable apparatus 100 to maintain a safer grasping temperature, as well as maintain the temperature of the contents of the drinking vessel. It is further contemplated that frame 105 may be constructed having multiple thin wall configurations, e.g., having two, three, or more walls with voids disposed therebetween. These voids may be, additionally or alternatively, exposed to or concealed from the ambient environment, as well as completely or partially filled with one or more insulating materials. According to one embodiment, the voids may be partially filled so as to lower a center of gravity of apparatus 100 and help prevent apparatus 100 from tipping and/or overturning. Furthermore, the wall(s) of frame 105 may be of uniform or variable thickness. It is contemplated that the aforementioned is also applicable to the composition of base 103.

Frame 105 may also be optionally provided with one or more, such as two, three, four, etc., symmetrically distributed notched portions, as seen in FIG. 1A, e.g., notches 121*a* and 121*b*, formed as substantially "U-shaped" voids extending for a predetermined distance 123, as seen in FIG. 1B, i.e., from the upper peripheral edge 105*c* to a bend apex 125 within a lower portion 105*f* of frame 105. As shown in FIG. 1B, notches 121*a* and 121*b* of FIG. 1A vary in width from an upper width 127 at the upper peripheral edge 105*c* to a lower width 129 at a predetermined distance 131 from the upper peripheral edge 105*c*, before arcuately decreasing to the bend apex 125, thus forming the "U" of the U-shape. The variance in notch width through distances 131 and/or 133 may vary linearly, exponentially, or arcuately, as well as in other suitable manner. Notches 121*a* and 121*b* may be symmetrically formed about a centerline perpendicularly extending from the bend apex 125 in a direction parallel to the y-axis (i.e., "y-direction"); however, embodiments of notches 121*a* and 121*b* are not so limited. Furthermore, while only two symmetrically distributed and symmetrically formed notches are illustrated, it is contemplated that embodiments of frame 105 including notched regions may include as few as one notch, and as many notches as will permit frame 105 to retain a sufficiently rigid shape for stabilizing a drinking vessel. It is also contemplated that the notched regions may be of any notch configuration including, but not limited to, rectangular, triangular, circular, etc., as well as any other notch pattern, such as a wavy configuration or other design. Moreover, the notched regions within frame 105 need not be symmetrically distributed about frame 105. In this manner, the configuration and disposition of the notched regions about frame 105, such as notches 121*a* and/or 121*b*, can be made to correspond to and receive one or more handles of various drinking vessels that may be supported by apparatus 100. The notched regions may, additionally or alternatively, serve to expose contact points of the drinking vessel stabilized by apparatus 100. Namely, the exposed regions of a drinking vessel disposed "behind" the notched regions may be grasped by a user so that the user may remove the drinking vessel from apparatus 100 via a lower portion of the drinking vessel.

According to certain embodiments, frame 105 may be formed having, or detachably coupled to, a plurality of biasing members, such as biasing members 107*a* and 107*b*, symmetrically or asymmetrically disposed about frame 105. As shown in FIG. 1A, biasing members 107*a* and 107*b* may be cantilevered from the upper peripheral edge 105*c* to project inwardly, i.e., in a direction parallel to the x-axis (i.e., "x-direction"), from the inner façade 105*b* towards an imaginary centerline CL and to extend downwardly, i.e., in the y-direction, towards the lower peripheral edge 105*d* seen only in FIG. 1B. Biasing members 107*a* and 107*b* may be resilient structures configured to achieve a predetermined spring constant, which may be configured linearly, variably, or in a step-wise fashion, as well as any other suitable configuration. Accordingly, biasing members 107*a* and 107*b* may be constructed using one or more resilient materials, e.g., hard carbons, alloy steels, stainless steels, nonferrous metals, high temperature alloys, plastics, etc. In this manner, a capacity of the inner cavity of frame 105 may be dynamically configurable. That is, when a portion of a drinking vessel is received by, or removed from, the inner cavity of frame 105, the plurality of biasing members, e.g., as seen in FIG. 1A, biasing members 107*a* and 107*b*, may be displaced towards, or away from, the inner façade 105*b*. In particular embodiments, the biasing members may firmly abut, or bias against, a portion of an outer surface of the drinking vessel received by the inner cavity of frame 105, wherein a magnitude of the biasing force will corresponding to, and be dependent upon, the predetermined spring constant of the biasing members. Exemplary biasing members are explained in more detail in accordance with FIGS. 3, 4, and 6A-6C.

Figure 2A:
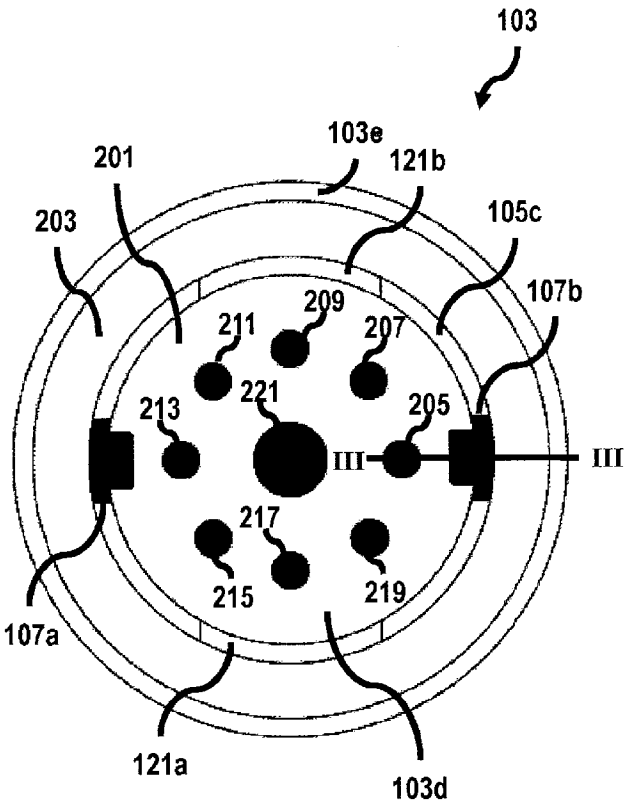
FIG. 2A is a top plan view of a first embodiment of the base with protrusions.
Figure 2C:
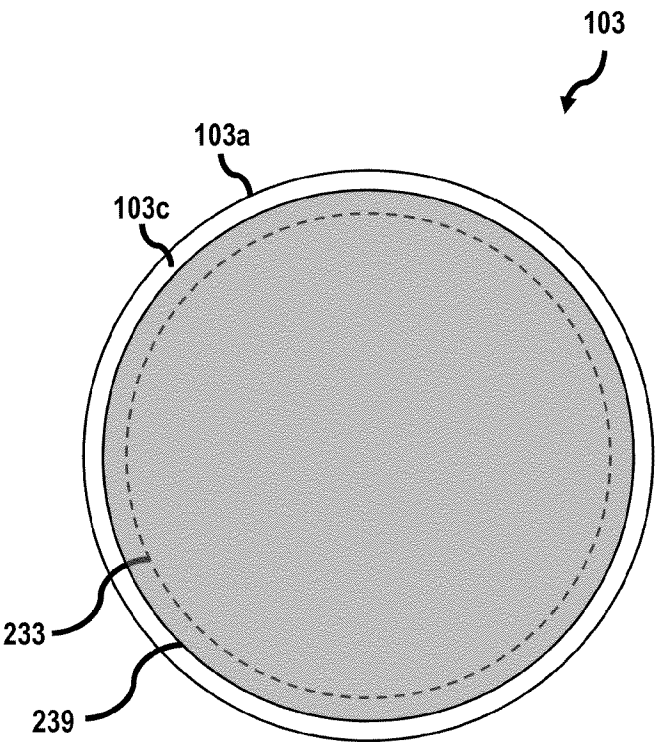
FIG. 2C is a bottom plan view of the base.
Figure 2B:
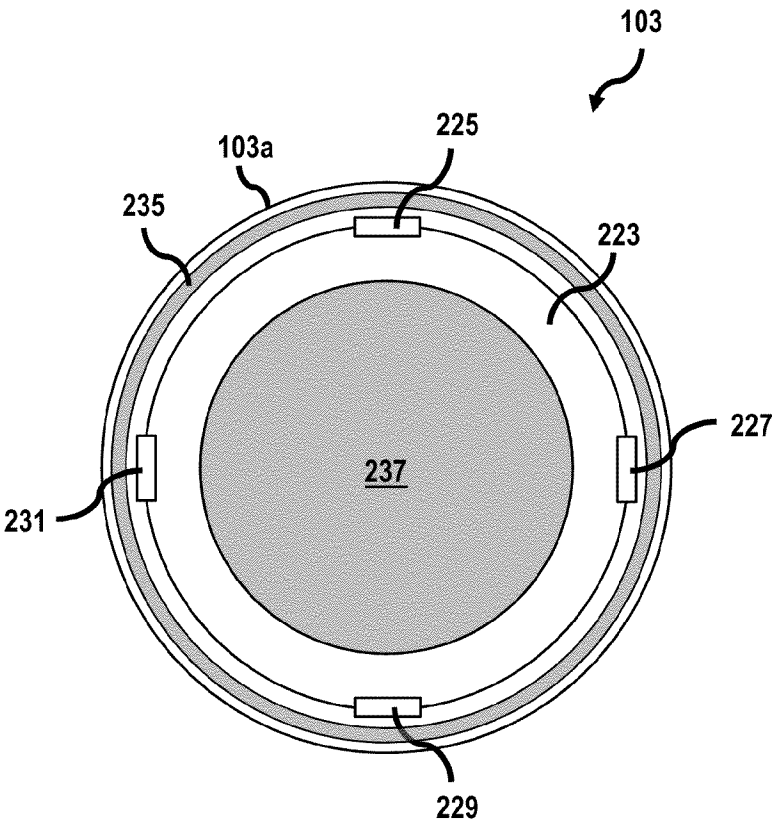
FIG. 2B is a top plan view of a second embodiment of the base without protrusions.
Figure 3:
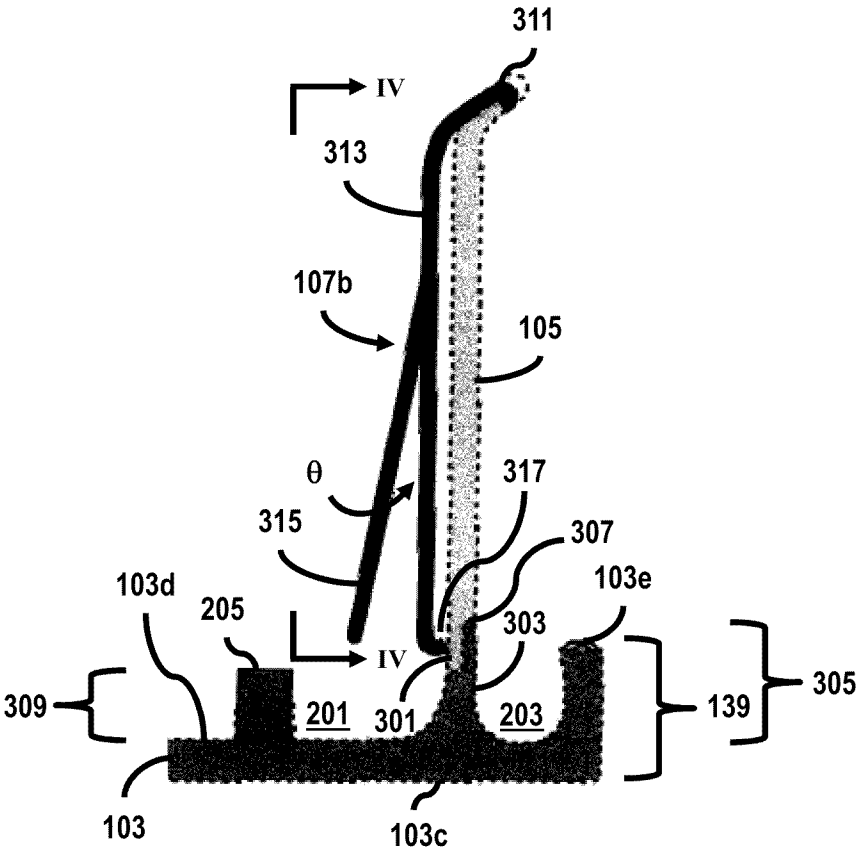
FIG. 3 is a sectional view schematically illustrating a plane III-III of the beverage holding apparatus, according to an exemplary embodiment.

Turning now to a more detailed description of base 103, FIGS. 2A-2C are various plan views schematically illustrating the base 103, according to various exemplary embodiments, while FIG. 3 is a sectional view schematically illustrating a plane III-III through FIG. 2A of the apparatus, according to an exemplary embodiment. With continued reference to FIGS. 1A and 1B, base 103 includes an outer façade 103*a*, an inner façade 103*b*, an outer bottom surface 103*c*, and an inner bottom surface 103*d*. The distal edges of façades 103*a* and 103*b* terminate at an upper surface 103*e*, of a predetermined width 135, thereby forming an opening to an inner cavity 137 of base 103. Inner cavity 137 extends in the y-direction from inner bottom surface 103*d* to an x-z plane parallel to upper surface 103*e*. While base 103 is illustrated having a relatively cylindrical configuration of a predetermined height 139 and width 141, other formations are contemplated, such as frustoconical, polygonal prism, etc., as well as any other suitable configuration.

Referring now to FIGS. 2A and 3, the inner cavity 137 of FIGS. 1A and 1B may be divided into an inner region 201 and an outer region 203 separated by, for example, a flange 303 of a predetermined height 305. It is contemplated, however, that any number of regions and/or configurations of inner cavity 137 may be provided. According to particular embodiments, as seen in FIG. 3, frame 105 may be contiguously formed from, or detachably coupled to, base 103 via flange 303. When detachably coupled to base 103, flange 303 may include a coupling region 307 for coupling purposes. Coupling region 307 may be configured to correspond to coupling region 301 of frame 105. The conjunction of, or interconnection between, coupling regions 301 and 307 may be utilized for detachably coupling or fixedly engaging frame 105 to base 103. Accordingly, frame 105 may be detachably coupled to or fixedly engaged with flange 303 via any suitable fitment, such as compression fitments, snap fitments, latch and grab fitments, etc. According to other embodiments, frame 105 may be detachably coupled to flange 303 via one or more fasteners, e.g., screws, rivets, etc., and/or adhesives.

In particular embodiments, as seen in FIG. 2A, the inner region 201 may include a plurality of protrusions, e.g., protrusions 205-219, extending in the y-direction a predetermined distance 309 in FIG. 3 from the inner bottom surface 103*d* of base 103. Protrusions 205-219 may be symmetrically or asymmetrically disposed about the inner region 201. According to one embodiment, protrusions 205-219 may be disposed at predetermined intervals about an annular circumference of inner region 201. It is contemplated, however, that the disposition of protrusions 205-219 may exhibit any suitable pattern or configuration. Further, protrusions 205-219 may be individually shaped as dimples, cylinders, polygonal prisms, etc., as well as combinations thereof. As such, protrusions 205-219 may include abrupt, chamfered, or smoothed edges, as well as edges of any other suitable configuration, such as step-wise edges. Additionally or alternatively, one or more central protrusions, e.g., central protrusion 221, as seen only in FIG. 2A, of a larger, smaller, or similar configuration to protrusions 205-219 may be provided. As shown, central protrusion 221 extends from a central location of inner region 201. That is, central protrusion 221 may be concentrically aligned with inner region 201 and may be disposed equidistantly from protrusions 205-219.

Accordingly, protrusions 205-221 may be configured to support a drinking vessel above inner bottom surface 103*d* of base 103. Namely, when a drinking vessel is received by apparatus 100, the drinking vessel may rest upon one or more of the upper surfaces of protrusions 205-221 instead of directly upon the inner bottom surface 103*d* of base 103. In this manner, as condensate rolls off of the drinking vessel and/or the contents of the drinking vessel are inadvertently spilled, these liquids can be collected in inner region 201 and retained below the drinking vessel. Such a configuration enables the drinking vessel to avoid coming in contact with these liquids, which, as previously described, can damage a resting surface 101 if allowed to collect thereon, as well as increase the possibility of a drinking vessel "floating" and/or overturning. Accordingly, outer region 203 may also collect and retain condensate that rolls-off of outer façade 105*a* of frame 105, as seen in FIG. 1A, as well as collect and retain liquid inadvertently spilled over the upper peripheral edge 105*c*. While not illustrated, a plurality of apertures may be provided through flange 303 of FIG. 3 for efficiently distributing any collected fluids between outer region 203 and inner region 201, which may increase a retaining capacity of the apparatus. In certain embodiments, one or more moisture absorbent inserts may be disposed within regions 201 and 203, which may also increase the retaining capacity of the apparatus. Exemplary moisture absorbent inserts are described with respect to FIGS. 5A and 5B.

According to certain embodiments, as seen in FIG. 2A, one or more of the outer surfaces of protrusions 205-221 may include, or be coupled to, a material (e.g., rubber, polymer, etc.) exhibiting a relatively higher coefficient of friction than protrusions 205-221 would otherwise exhibit. Additionally or alternatively, the outer surfaces of protrusions 205-221 and/or the aforementioned friction material(s) may include one or more textures, such as a plurality of bumps, grooves, protrusions, ridges, serrations, splines, etc., to further increase the coefficient of friction of the one or more surfaces of protrusions 205-221. As such, the friction materials and textures help prevent a drinking vessel supported by the apparatus from "floating," sliding, slipping, etc. In various other embodiments, protrusions 205-221 may include, or be coupled to, a resilient material exhibiting the aforementioned friction surface. In this manner, the resilient material may be configured to conform to a bottom surface of a drinking vessel resting upon protrusions 205-221.

Referring now to FIGS. 2B and 2C, i.e., top and bottom plan views, respectively, illustrating the base 103 according to various exemplary embodiments, it is contemplated that base 103 may be optionally "weighted" and/or shaped to lower a center of gravity of the apparatus, as well as help prevent the apparatus from inadvertently tipping and/or overturning. In certain embodiments, the base 103 may be configured from a relatively more dense material than the frame. According to other embodiments, as seen in FIG. 2B, a weight 223 may be coupled to base 103, such as by one or more clips 225-231, screws, rivets, adhesive bonds, chemical bonds, etc., as well by compression fitments. Weight 223 may be shaped as a cylindrical disk (or exhibit any other suitable configuration) and may be configured from cement or any other relatively dense and/or inexpensive material. As such, weight 223 may be recessed into base 103 such that an outer surface of weight 223 can remain flush with the outer façade 103*a*. Further, weight 223 may include one or more countersunk (or notched) regions configured to accept clips 225-231 (or other coupling mechanisms, e.g. screws) so that an outer surface of clips 225-231 (or the other coupling mechanisms) may remain flush with the outer façade 103*a*. Additionally or alternatively, as seen in FIG. 2C, base 103 may include a voided inner cavity 233 that can be entirely or partially filled with a relatively dense material or aqueous liquid, such as beads, cement, sand, sol-gel, water, etc.

As seen in FIGS. 2B and 2C, the base 103 may also include, or be coupled to, one or more regions 235-239 including a material (e.g., rubber, polymer, etc.) exhibiting a relatively higher coefficient of friction than the outer bottom surface 103*c* would otherwise exhibit. Additionally or alternatively, the outer bottom surface 103*c* and/or the material(s) of regions 235-239 may include one or more textures, such as a plurality of bumps, grooves, protrusions, ridges, serrations, splines, etc., to further increase the coefficient of friction of base 103. According to certain embodiments, regions 235-239 may wholly or partially extend over and/or about the outer bottom surface 103*c*. Regions 235 and 237 in FIG. 2B may wholly, partially, or not conceal weight 223. In the one embodiment seen in FIG. 2C, region 239 may serve as a detachably coupled or fixedly engaged cap to voided inner cavity 233. As such, all or portions of the outer bottom surface 103*c* may include, or be coupled to, the aforementioned friction material(s) and/or texture(s), which may be formed to a circumferential, radial, or combination thereof pattern. Accordingly, regions 235-239 can help prevent the apparatus from sliding and/or damaging (e.g., scratching) the resting surface.

Figure 5B:
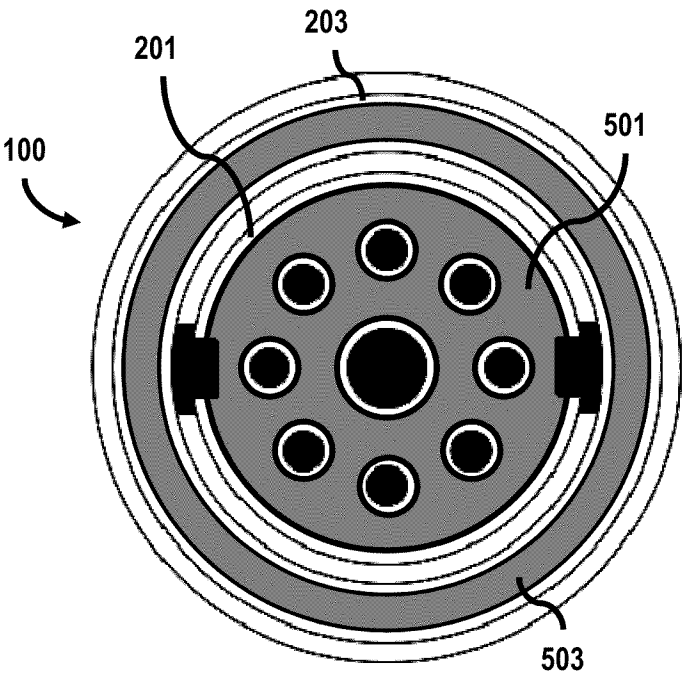
FIGS. 5A and 5B are top plan views schematically illustrating moisture absorbent inserts of the beverage holding apparatus, according to various exemplary embodiments.
Figure 5A:
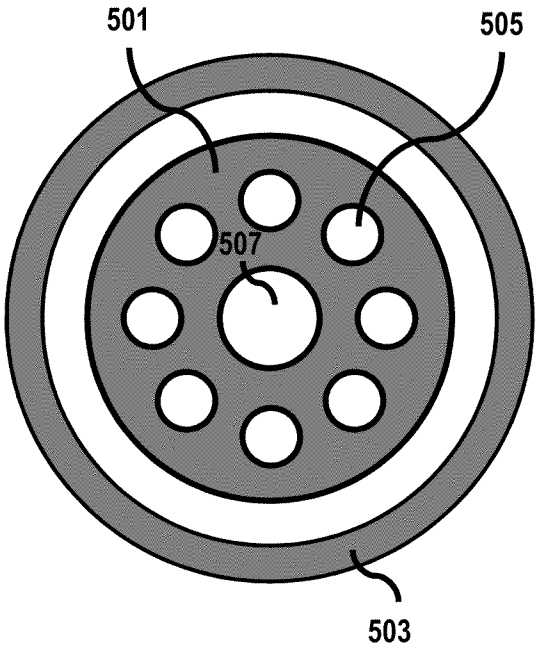

As mentioned earlier, base 103 may be optionally provided with one or more disposable and/or reusable moisture absorbent inserts in order to increase a liquid retaining capacity of apparatus 100, as well as provide a readily available cleanup tool. FIGS. 5A and 5B are top plan views schematically illustrating moisture absorbent inserts 501 and 503 of apparatus 100, according to various exemplary embodiments. In FIG. 5A, the inserts 501 and 503 are shown standing alone outside the apparatus 100; in FIG. 5B, inside the apparatus 100. As shown in FIG. 5B, moisture absorbent inserts 501 and 503 may be configured to correspond to inner region 201 and outer region 203, respectively. That is, insert 501 may be cylindrical in shape and may include a plurality of apertures, such as apertures 505 and 507 seen in FIG. 5A, so that the various exposed surfaces of insert 501 may substantially correspond to the various exposed surfaces of inner region 201. Similarly, insert 503 may be annularly shaped so that the various exposed surfaces of insert 503 may substantially correspond to the various exposed surfaces of outer region 203. According to one embodiment, inserts 501 and 503 are sized such that, even when inserts 501 and 503 are fully saturated, an upper most surface of inserts 501 and 503 will not come in contact with a drinking vessel supported by protrusions 205-221 of FIG. 2A. As such, inserts 501 and 503 may be manufactured from any moisture absorbent material, such as cloth, paper, sponge, wood fiber, etc. It is contemplated, however, that inserts 501 and/or 503 may be provided having any suitable size, shape, and/or configuration so as to correspond to the various regions of base 103 of FIG. 2A, as well as collect and retain liquids therein. As such, in the event a user inadvertently drops or spills the contents of their drinking vessel on the resting surface 101 of FIG. 1A, inserts 501 and/or 503 may be available for quickly and efficiently cleaning up the mess.

Figure 4:
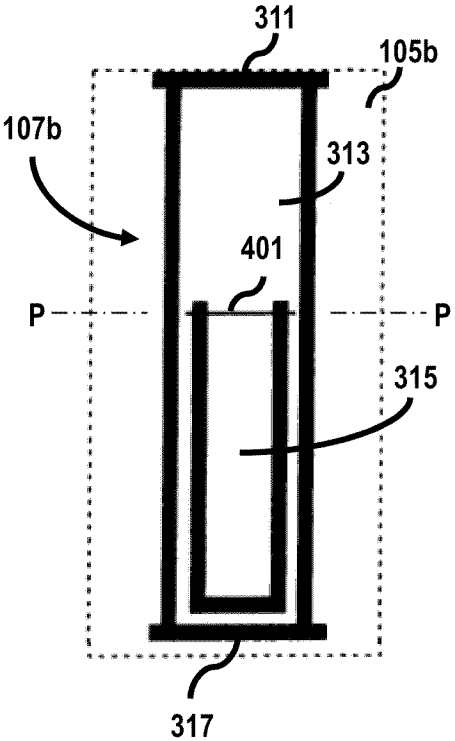
FIG. 4 is a sectional view schematically illustrating a biasing member of the beverage holding apparatus taken along a line IV-IV, according to an exemplary embodiment.

Turning now to a more detailed description of biasing members 107*a* and 107*b*, FIG. 4 is a sectional view schematically illustrating biasing member 107*b* of the apparatus taken along a line IV-IV of FIG. 3, according to an exemplary embodiment. With combined reference to FIGS. 3 and 4, biasing member 107*b* includes a coupling portion 311, a beam portion 313, a cantilevered portion 315, and a support portion 317. Coupling portion 311 is configured to be fixedly engaged or detachably coupled to frame 105, such as by adhesives, fasteners, latch and grab fitments, snap fitments, mating engagements, etc. According to one embodiment, coupling portion 311 may be fixedly engaged or detachably coupled in FIG. 1A to the upper peripheral edge 105*c* and/or the curved region 105*e*, e.g., the collar of frame 105. Beam portion 313 in FIG. 3 is configured to extend from coupling portion 311 in the y-direction towards base 103 and into the inner cavity region of frame 105, as well as configured to support cantilevered portion 315. According to particular implementations, beam portion 313 may, itself, be cantilevered from frame 105. In other instances, beam portion 313 may be simply supported, e.g., abut against, frame 105 via support portion 317. Support portion 317 may be, alternatively, fixedly engaged or detachably coupled in FIG. 1A to an inner surface of lower portion 105*f* of frame 105. In this manner, cantilevered portion 315 in FIG. 3 may extend in the x-direction towards centerline CL of FIG. 1A, as well as in the y-direction towards base 103. That is, cantilevered portion 315 of FIG. 3 may project from beam portion 313 at a predetermined angle θ. As such, cantilevered portion 315 may pivot about an imaginary pivot axis P in FIG. 4 when excited, i.e., when a portion of a drinking vessel is received by, or removed from, the inner façade 105*b* of frame 105. In certain implementations, cantilevered portion 315 may be fixedly engaged or detachably coupled to beam portion 313 via a pin 401 or other suitable mechanism axially centered about pivot axis P.

Figure 6C:
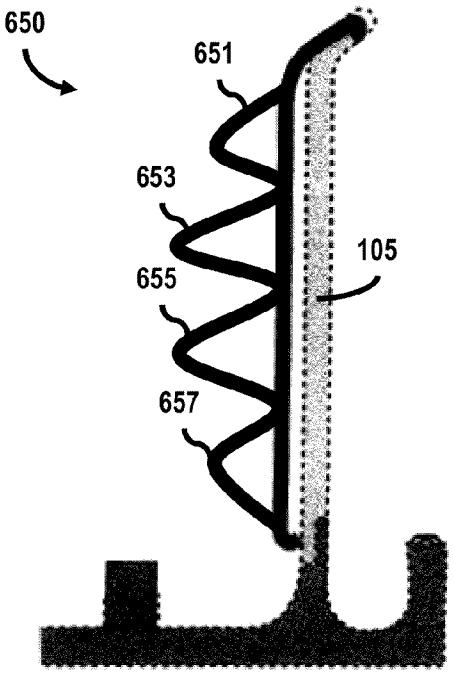
FIGS. 6A-6C schematically illustrate various biasing member configurations of the beverage holding apparatus, according to various exemplary embodiments.
Figure 6B:
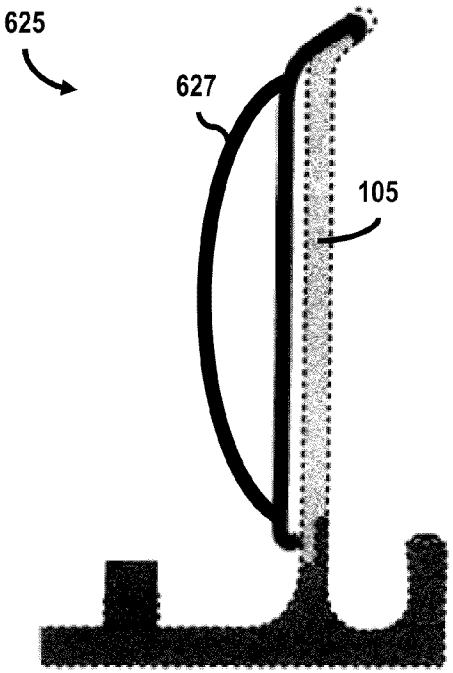
Figure 6A:
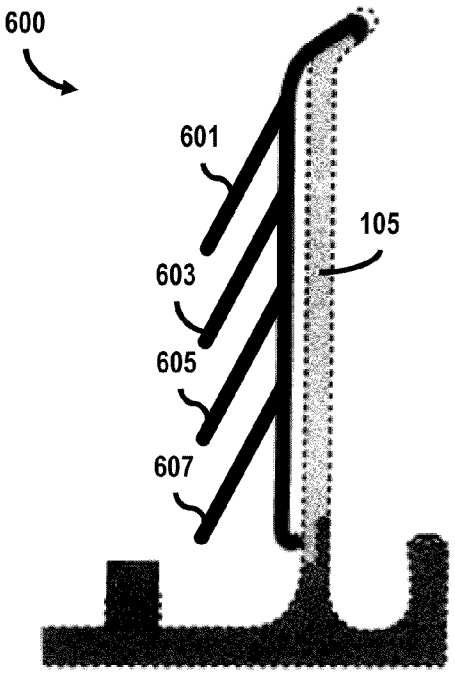

According to other embodiments, the biasing members of the apparatus, such as biasing member 107*b*, may be configured having alternative or additional configurations. FIGS. 6A-6C schematically illustrate various biasing member configurations of the apparatus, according to various exemplary embodiments. As seen in FIG. 6A, biasing member 600 includes a plurality of cantilevered portions 601-607 for biasing against one or more surfaces of a drinking vessel received by the inner cavity of frame 105. While only four cantilevered portions are illustrated, it is contemplated that any number of cantilevered portions may be provided and may be provided with any suitably contoured configuration. In this manner, as a portion of a drinking vessel is received by the inner cavity of frame 105, cantilevered portions 601-607 may bias against a larger surface area of the drinking vessel, as well as provide a more contoured abutment to the drinking vessel. In FIG. 6B, biasing member 625 includes an arcuate biasing portion 627, such as a semielliptical arcuate spring, for biasing against a drinking vessel received by the inner cavity of frame 105. As biasing member 627 is compressed towards frame 105, a contour of biasing member 627 may conform to an outer surface of a drinking vessel received by the inner cavity of frame 105. According to other embodiments, the biasing members may be constructed having wave-like configurations, such as biasing member 650 illustrated in FIG. 6C. While biasing member 650 only includes four wave projections 651-657, it is contemplated that any number or configuration of waves may be provided. As with biasing member 600, when a drinking vessel is received by the inner cavity of frame 105, waves 651-653 may bias against a larger surface area of the drinking vessel, as well as provide a more contoured abutment to the drinking vessel. Accordingly, biasing members 600, 625, and/or 650, as well as any other like or suitable configuration, may be provided for achieving a predetermined biasing force, i.e., stabilization force, of the inner cavity of frame 105. As such, apparatus 100 may be configured with one or more of the aforementioned biasing members to adequately support and stabilize a drinking vessel in a secure, upright fashion.

As previously mentioned, apparatus 100 (or portions thereof) may be integrally formed and/or configured. FIG. 7 schematically illustrates a contiguously formed beverage holding apparatus 700, according to an exemplary embodiment. As shown, beverage holding apparatus 700 includes a unitary body 701 detachably coupled to or fixedly engaged with a plurality of biasing members, e.g., biasing members 703*a* and 703*b*. Apparatus 700 may be similarly configured as compared to apparatus 100; however, unitary body 700 may include a frame 705 integrally formed from a weighted base 707. In this manner, apparatus 700 may include an inner cavity 709 for receiving and stabilizing a drinking vessel in an upright fashion. Inner cavity 709 is bounded by a contoured outer façade 711. As with apparatus 100, inner cavity 709 may be of variable capacity for receiving and stabilizing drinking vessels of various sizes, shapes, and configurations. Further, while the weighted base 707 is illustrated without an outer region for collecting roll off condensate and/or inadvertently spilled fluids, base 707 is not so limited. As previously mentioned, frame 705 may be integrally formed from an inner flange of base 707, such that an outer region, as well as an inner region for collecting roll-off condensate and/or inadvertently spilled fluids may be provided.

Figure 8:
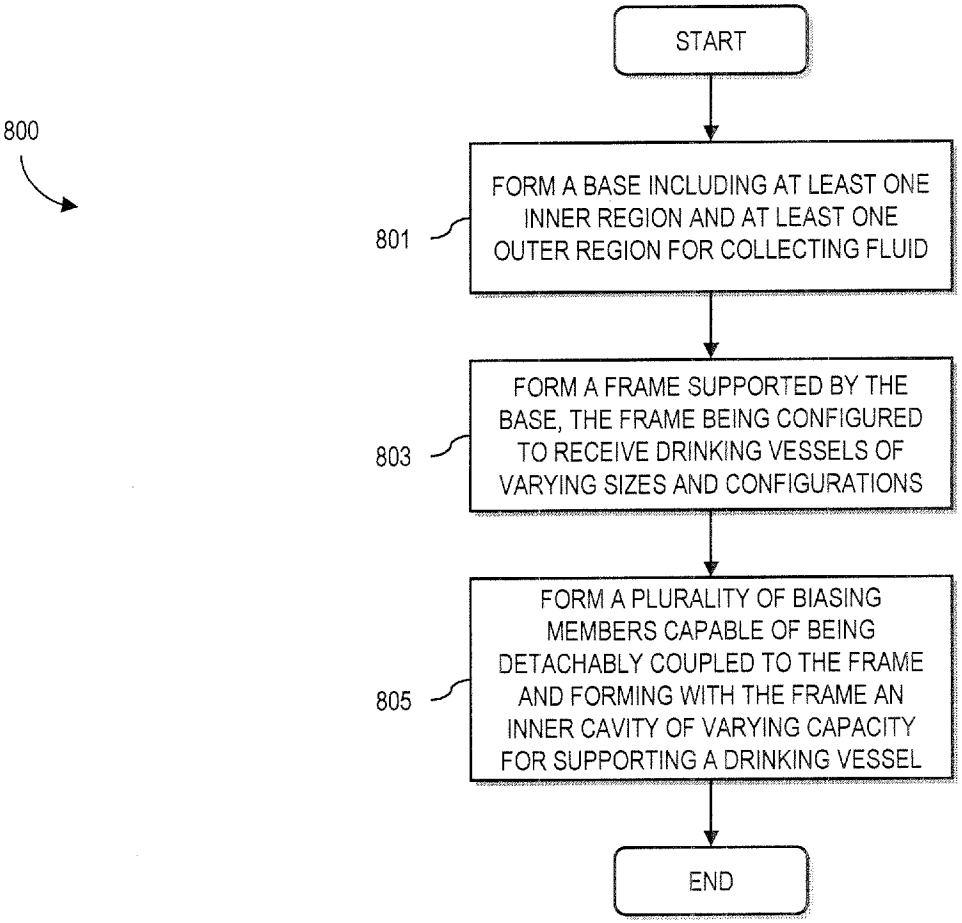
FIG. 8 is a flowchart of a process for manufacturing a beverage holding apparatus, according to an exemplary embodiment.

FIG. 8 is a flowchart of a process for manufacturing a beverage holding apparatus, according to an exemplary embodiment. For the purposes of explanation, process 800 is described with respect to apparatus 100. In step 801, a base (e.g., base 103) may be formed, such as by blowing, casting, extruding, forging, machining, molding, stamping, etc., as well as combinations thereof, to include at least one inner region and at least one outer region (e.g., inner and outer regions 201 and 203, respectively) for collecting fluid, such as roll-off condensate from a drinking vessel and/or a beverage holding apparatus (e.g., apparatus 100), content inadvertently spilled from the drinking vessel, etc. It is noted that the drinking vessel may be of various sizes, shapes, and configurations, as well as include one or more handles. According to particular embodiments, the base may be formed to accept at least one moisture absorbent insert (e.g., insert 501 and/or 503) in the at least one inner and/or the at least one outer region, the at least one insert being configured to substantially correspond to the at least one inner and/or at least one outer region, and also being configured to absorb fluid collected in the at least one inner and/or at least one outer region. The base may also be formed with a plurality of protrusions (e.g., protrusions 205-221) for supporting a drinking vessel above fluid collected in the at least one inner region. In certain embodiments, an outer bottom surface (e.g., outer bottom surface 103*c*) of the base may be formed to include a relatively high friction portion (e.g., regions 235-239) for preventing the base from sliding on a resting surface (e.g., resting surface 101). This relatively high friction portion may include or may be constructed with a textured surface having bumps, grooves, protrusions, ridges, serrations, splines, or a combination thereof, formed to a circumferential, radial, or combination thereof pattern.

At step 803, a frame (e.g., frame 105) may be formed, such as by blowing, casting, extruding, forging, machining, molding, stamping, etc., as well as combinations thereof, for receiving drinking vessels of varying sizes and configurations. The frame may be formed to be supported by the base. Namely, the base may be formed to include a flange (e.g., flange 303) from which the frame may be either detachably coupled to or integrally formed from. The flange may also separate the at least one inner region from the at least one outer region. In particular embodiments, the frame may be formed having relatively annular cross section and may be formed to include a first relatively annular opening (e.g., opening 109) of a first diameter (e.g., diameter 119) for receiving a drinking vessel and a second relatively annular opening (e.g., opening 111) of a second diameter (e.g., diameter 113) for allowing fluid to collect in the at least one inner region of the base. According to various embodiments, the frame may also be formed to include a plurality of contoured notched regions (e.g., notches 121*a* and 121*b*) for receiving one or more handles of a drinking vessel.

Per step 805, a plurality of biasing members (e.g., biasing members 107*a* and 107*b*) may be formed. The biasing members may be configured to detachably couple to the frame and form with the frame an inner cavity of varying capacity for supporting a drinking vessel. In certain embodiments, individual biasing members may be formed to include one or more cantilevered portions (e.g., cantilevered portions 315 and/or 601-607), the individual biasing members also being configured to be detachably coupled to an upper periphery (e.g., upper peripheral edge 105*c*) of the frame, as well as configured to bias against an outer surface of a drinking vessel received by the inner cavity. Other embodiments may include individual biasing members including arcuate spring portions (e.g., arcuate biasing portion 627 and/or wave projections 651-657) of a semielliptical or wave-like configuration.

Figure 9:
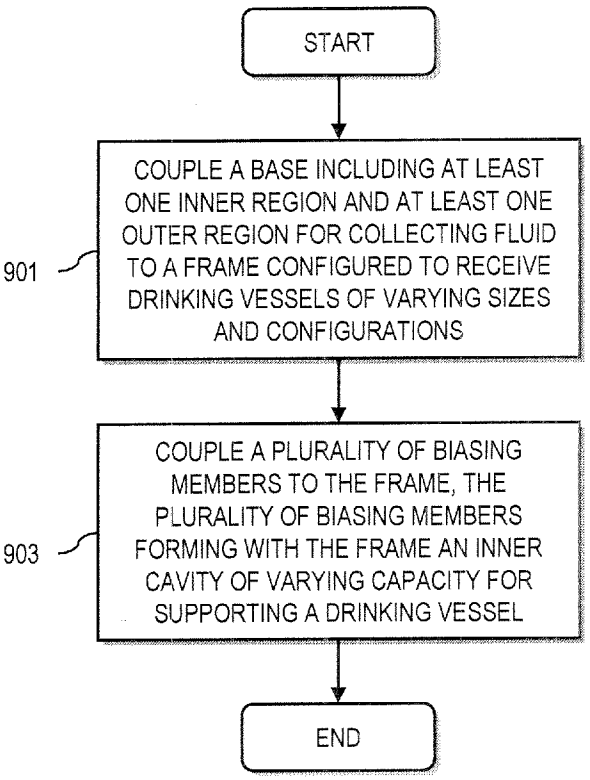
FIG. 9 is a flowchart of a process for assembling a beverage holding apparatus, according to an exemplary embodiment.

FIG. 9 is a flowchart of a process for assembling a beverage holding apparatus, according to an exemplary embodiment. For the purpose of explanation, process 900 is described with respect to apparatus 100. In step 901, a base (e.g., base 103) including at least one inner region (e.g., inner region 201) and at least one outer region (e.g., outer region 203) for collecting fluid may be coupled to a frame (e.g., frame 105) configured to receive drinking vessels of varying sizes and configurations. In particular embodiments, the base may be coupled to the frame via any suitable fitment, such as by compression fitments, snap fitments, latch and grab fitments, etc., as well as (or in addition to) one or more fasteners, e.g., screws, etc., or adhesives. According to certain embodiments, at least one moisture absorbent insert (e.g., inserts 501 and/or 503) may be disposed in the at least one inner and/or the at least one outer region for absorbing fluid collected in the at least one inner and/or the at least one outer region. In various embodiments, the base may further include a plurality of protrusions (e.g., protrusions 205-221) configured to support the drinking vessel above fluid collected in the at least one inner region, and a flange (e.g., flange 303) separating the at least one inner region from the at least one outer region, the flange being configured for detachably coupling the base to the frame. The frame may be relatively annular in cross section and may include a first relatively annular opening (e.g., opening 109) of a first diameter (e.g., diameter 119) for receiving the drinking vessel, a second relatively annular opening (e.g., opening 111) of a second diameter (e.g., diameter 113) for allowing fluid to collect in the at least one inner region, and a plurality of contoured notched regions (e.g., notches 121*a* and 121*b*) for receiving one or more handles of the drinking vessel. Nevertheless, at step 903, a plurality of biasing members (e.g., biasing members 107*a* and 107*b*) may be coupled to the frame, the plurality of biasing members forming with the frame an inner cavity of varying capacity for supporting a drinking vessel.

Accordingly, a beverage holding apparatus, such as apparatus 100, may be provided via processes 800 and 900. In this manner, when a portion of a drinking vessel traverses the inner cavity of the frame, a capacity of the inner cavity may be dynamically configured to correspond to the size, shape, and configuration of the drinking vessel received therein. Furthermore, when the portion of the drinking vessel is received by the inner cavity of the frame, the plurality of biasing members may be displaced towards an inner façade (e.g., inner façade 105*b*) of the frame, such that the biasing members may firmly abut, or bias against, a portion of an outer surface of the drinking vessel. Further, any handle(s) of the drinking vessel may be received by the one or more notched regions of the frame. Moreover, the drinking vessel may be rested on the base. That is, when the drinking vessel traverses the entirety of the inner cavity of the frame, a bottom surface of the drinking vessel may be supported on one or more of the upper surfaces of the protrusions of the base. In this manner, the drinking vessel can be supported above, i.e., elevated from, an inner bottom surface (e.g., inner bottom surface 103*d*) of the base.

As such, a drinking vessel can be stabilized and adequately secured via the beverage holding apparatus provided via processes 800 and 900, such as apparatus 100. Namely, the conjunction of the frame, the plurality of biasing members, and the base can stabilize and adequately secure the drinking vessel in an upright fashion. Accordingly, any undesirable condensate that rolls off of or content that is inadvertently spilled from the drinking vessel and/or the beverage holding apparatus may be collected and retained by the at least one inner and/or at least one outer regions. Further, the moisture absorbent inserts may be respectively utilized to increase the retaining capacity of the at least one inner and/or the at least one outer regions, as well as be available for cleanup purposes in the event of a spilling accident.

Thus, the beverage holding apparatus of processes 800 and 900 can advantageously support and stabilize a drinking vessel in an upright fashion, as well as prevent moisture related damages from occurring on a resting surface, damages such as water stains, veneer separation, raised grains, discoloration, and the like, to the materials of the resting surface. Moreover, given that a drinking vessel supported by the beverage holding apparatus is not directly in contact with liquid collected and retained by the base, the drinking vessel will be kept from being soiled and/or saturated, as well as prevented from experiencing the adverse effects of surface tension previously described. This will also help prevent spilling accidents, such as those accidents related to a wet drinking vessel slipping out of a drinker's hand.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A beverage holding apparatus comprising:

a base including at least one inner region and at least one outer region, wherein the at least one inner region and the at least one outer region are in fluid communication; and a frame supported by the base and configured to receive drinking vessels of varying sizes and configurations, the frame coupled to the base between the at least one inner region and the at least one outer region, the frame comprising cylindrical walls with at least one notched region for receiving one or more handles of the drinking vessel, the at least one notch region extending down from an upper peripheral edge of the frame, the upper peripheral edge of the frame distal from a portion of the frame supported by the base, the frame extending vertically from the base to a height above the base and accessible from a position outside the base in a direction perpendicular to a side of the frame, an interior of the frame forming an inner cavity for supporting a drinking vessel, the frame at least partially surrounding the drinking vessel when the drinking vessel is placed in the frame in the inner cavity, the at least one inner region and the at least one outer region shaped for collecting moisture from the drinking vessel, wherein a capacity of the inner cavity is adaptively configured when a portion of the drinking vessel is received in the inner cavity.

2. An apparatus according to claim 1, further comprising a moisture absorbent insert disposed in and configured to substantially correspond to the at least one inner region for absorbing moisture collected in the at least one inner region, wherein the moisture absorbent insert increases a moisture retaining capacity of the inner cavity.

3. An apparatus according to claim 1, wherein the base further includes a plurality of protrusions extending vertically from the base and shaped to support the drinking vessel above a bottom of the at least one inner region.

4. An apparatus according to claim 3, wherein the plurality of protrusions further comprise a relatively high friction portion at top of each protrusion.

5. An apparatus according to claim 1, wherein the frame is relatively annular in cross section and comprising a first relatively annular opening of a first diameter for receiving the drinking vessel.

6. An apparatus according to claim 1, further comprising one or more cantilevered springs detachably coupled to an upper periphery of the frame and configured to bias against an outer surface of the drinking vessel.

7. An apparatus according to claim 1, further comprising one or more arcuate springs of a semielliptical or wave-like configuration detachably coupled to an upper peripheral edge of the frame and further configured to bias against an outer surface of the drinking vessel.

8. The apparatus of claim 1, wherein the base and the frame are integrally formed.

9. The apparatus of claim 1, wherein the base comprises a plurality of apertures located between the at least one inner region and the at least one outer region.

10. The apparatus of claim 1, wherein the upper peripheral edge of the frame flares outwardly and does not engage the drinking vessel, the upper peripheral edge of the frame distal to a location where the base is coupled to the frame.

11. A method comprising:

forming a base including at least one inner region and at least one outer region, wherein the at least one inner region and the at least one outer region are in fluid communication; and forming a frame, the frame being configured to receive drinking vessels of varying sized and configurations, the frame coupled to the base between the at least one inner region and the at least one outer region, the frame comprising cylindrical walls with at least one notched region for receiving one or more handles of the drinking vessel, the at least one notch region extending down from an upper peripheral edge of the frame, the upper peripheral edge of the frame distal from a portion of the frame supported by the base, the frame extending vertically from the base to a height above the base and accessible from a position outside the base in a direction perpendicular to a side of the frame, an interior of the frame forming an inner cavity for supporting a drinking vessel, the frame at least partially surrounding the drinking vessel when the drinking vessel is placed in the frame in the inner cavity, the at least one inner region and the at least one outer region shaped for collecting moisture from the drinking vessel, wherein a capacity of the inner cavity is adaptively configures when a portion of the drinking vessel is received by the inner cavity.

12. A method according to claim 11, further comprising forming at least one moisture absorbent insert disposed in the at least one inner or the at least one outer region, the at least one insert increasing a capacity to absorb fluid collected in the at least one inner or the at least one outer region.

13. A method according to claim 11, wherein the base further comprises a plurality of protrusions extending vertically from the base and shaped to support the drinking vessel above a bottom of the at least one inner region, and a flange separating the at least one inner region from the at least one outer region, the frame being either detachably coupled to the flange.

14. A method according to claim 11, wherein the frame further comprises one or more cantilevered springs detachably coupled to an upper peripheral edge of the frame and configured to bias against an outer surface of the drinking vessel.

15. A method according to claim 11, wherein the frame further comprises arcuate springs of a semielliptical or wave-like configuration detachably coupled to an upper peripheral edge of the frame and further configured to bias against an outer surface of the drinking vessel.

16. An apparatus comprising:

a weighted cylindrical base that supports a beverage container and lowers a center of gravity of the apparatus, the base comprising an inner recess and an outer recess, the inner recess comprising one or more protrusions extending vertically from a bottom of the inner recess for elevating the beverage container above condensate and spilled fluid collected in the inner recess, the inner recess in fluid communication with the outer recess; and a cylindrical sleeve extending from the base, the sleeve comprising at least one notched region for receiving one or more handles of the drinking vessel, the at least one notch region extending down from an upper peripheral edge of the sleeve, the upper peripheral edge of the sleeve distal from the base, the sleeve is accessible from a position outside the base in a direction perpendicular to a vertical axis, the sleeve shaped to receive a portion of the beverage container in an inner region thereof, the cylindrical sleeve coupled to the base between the inner recess and the outer recess.

17. The apparatus of claim 16, further comprising:

an insert disposed in and configured to correspond to a configuration of the inner recess, wherein the insert absorbs condensate and spilled fluid collected in the inner recess.

18. The apparatus of claim 16, wherein the cylindrical sleeve is detachably coupled to the base, one or more handles of the beverage container project through the at least one notched region to an exterior of the apparatus.

19. The apparatus of claim 16, wherein the apparatus comprising one or more of cantilevered springs, arcuate springs with a semielliptical configuration, or arcuate springs with a wave-like configuration.

* * * * *